US012134891B2

(12) United States Patent
Lewin

(10) Patent No.: US 12,134,891 B2
(45) Date of Patent: Nov. 5, 2024

(54) SEPARATION PANELS IN FOOD PRODUCTION

(71) Applicant: Jesse James Lewin, Manchester, IA (US)

(72) Inventor: Jesse James Lewin, Manchester, IA (US)

( * ) Notice: Subject to any disclaimer, the term of this patent is extended or adjusted under 35 U.S.C. 154(b) by 18 days.

(21) Appl. No.: 17/896,793

(22) Filed: Aug. 26, 2022

(65) Prior Publication Data

US 2024/0068230 A1 Feb. 29, 2024

(51) Int. Cl.
*E04B 2/74* (2006.01)

(52) U.S. Cl.
CPC .... *E04B 2/7416* (2013.01); *E04B 2002/7487* (2013.01)

(58) Field of Classification Search
CPC .... E04B 2/7416; E04B 2/7433; E04B 2/7457; E04B 2/7453; E04B 2/7405; E04B 2/7401; E04B 2002/7418; E04B 2002/742; E04B 2/7435; E04B 2/7437; E04B 2/7438; E04B 2/7444; E04B 2002/7446
See application file for complete search history.

(56) References Cited

U.S. PATENT DOCUMENTS 4,103,981 A * 8/1978 Donahue ..... A47B 17/003 312/265.6
4,631,881 A * 12/1986 Charman ..... H02G 3/288 174/495
5,875,596 A * 3/1999 Muller ..... E04B 2/7433 52/239
6,000,180 A * 12/1999 Goodman ..... E04B 2/7425 52/239
6,120,206 A * 9/2000 Benner ..... A47B 47/03 312/265.5
6,295,764 B1 * 10/2001 Berridge ..... E04B 2/7425 52/36.5
8,176,695 B2 * 5/2012 Deweerd ..... E04B 2/7425 52/239
8,656,648 B2 * 2/2014 Liegeois ..... E04B 2/7425 52/36.6
2014/0283459 A1 * 9/2014 Maxam ..... E04B 1/28 52/220.1
2019/0292776 A1 * 9/2019 Maxam ..... E04B 2/7407
2021/0396022 A1 * 12/2021 Crenshaw ..... E04F 13/0898
2022/0312960 A1 * 10/2022 Junge ..... A47B 47/0041

FOREIGN PATENT DOCUMENTS

DE 20108303 U1 * 8/2001 ..... A47B 96/067
GB 2290806 A * 1/1996 ..... E04B 2/7416
JP 2004137731 A * 5/2004
KR 20180047176 A * 5/2018
KR 102165497 B * 10/2020
KR 20210136711 A * 11/2021
WO WO-2021072476 A1 * 4/2021 ..... E04F 11/1812

* cited by examiner

*Primary Examiner* — Theodore V Adamos
(74) *Attorney, Agent, or Firm* — SHUTTLEWORTH & INGERSOLL, P.L.C.; Elizabeth L. Souer

(57) ABSTRACT

A barrier panel to separate food production operations and/or operators in food processing facilities, minimizing contact between the components to minimize bacteria and contaminant harbors, which requires little or no disassembly for cleaning, the upper portion of the panel being translucent or transparent and supported by contact tabs which are rounded to minimize surface area touches.

17 Claims, 12 Drawing Sheets

SEPARATION PANELS IN FOOD PRODUCTION

This application claims priority to U.S. Provisional Application No. 63/237,417 filed Aug. 26, 2021, the entirety of which is incorporated by reference herein.

BACKGROUND OF THE INVENTION

Food production areas must be designed to maintain sanitary conditions and for ease of cleaning and maintenance. Food processing and production require extra precautions compared to other manufacturing environments to prevent contaminants. Appropriate wall and floor surfaces must be chosen to facilitate sanitary conditions. In addition, appropriate barriers may be used to isolate products and prevent contaminants in the products.

Also, in areas where production workers are in close contact with one another, there is a desire and a need to separate people as they flow in opposite directions, perform work in areas where tasks must be separated, wear different garments from each other as specified by specific product contact, as well as many other reasons. Such separation of production workers may also prevent cross-contamination of food products as well as the spread of illness between production workers.

To separate production workers, manufacturers may spread out processes or tasks, or may erect barriers between workers. Spreading out processes or tasks requires a larger footprint for manufacturing, longer conveyors and other equipment, and is not usually an economically viable solution. Many manufacturers opt to erect barriers instead. Specific guidelines require such barriers used to create the separation between personnel to be washed and sanitized frequently.

Such barriers may be embodied as panels. Barriers must be easy to sanitize, and are preferably transparent or translucent so that production workers may see the products and processes before and after their stations.

There are several options for materials for such barriers, including: plastic, plexiglass, glass, and stainless steel, each having benefits and drawbacks. Plastic and plexiglass are lightweight, flexible, and shatter-resistant. However, plastic surfaces degrade over time, which creates space for bacterial and other contaminants, and would need to be frequently replaced to maintain the integrity of the panels. Glass is heavy and easily breaks during removal for cleaning. Stainless steel does not have the translucent qualities desirable in manufacturing to see the products and processes before and after each station.

Panels in food production must be cleaned frequently. One concern in food processing and production is space and connection or contact points where contaminants may become trapped and are difficult to clean. It is desirable for panel assemblies to have as few contact points as possible to minimize contamination. It is also beneficial for panel assemblies to be easy to disassemble for panel replacement.

Various panels and panel holders have been manufactured in the past. But none confront the issue of harboring bacteria in design. Existing products hold panels vertically with the use of a gripping device on various edges of the panel. The process of gripping the panel between two surfaces generates an area which harbors bacteria.

SUMMARY OF THE INVENTION

The barrier disclosed herein includes a panel designed to minimize bacteria and contaminants, separate workers, and be properly maintained easily.

DETAILED DESCRIPTION

An invention herein disclosed is a barrier panel to separate food production operations and/or operators in food processing facilities. The panel assembly 100 minimizes contact between the components to minimize bacteria and contaminant harbors. In addition, the panel assembly 100 does not need to be disassembled for cleaning. The upper panel portion 120 may be removed easily, but does not have to be removed for cleaning.

The panel assembly 100 may be made in various sizes and shapes, depending on the height and width needed for adequate separation.

Figure 1:
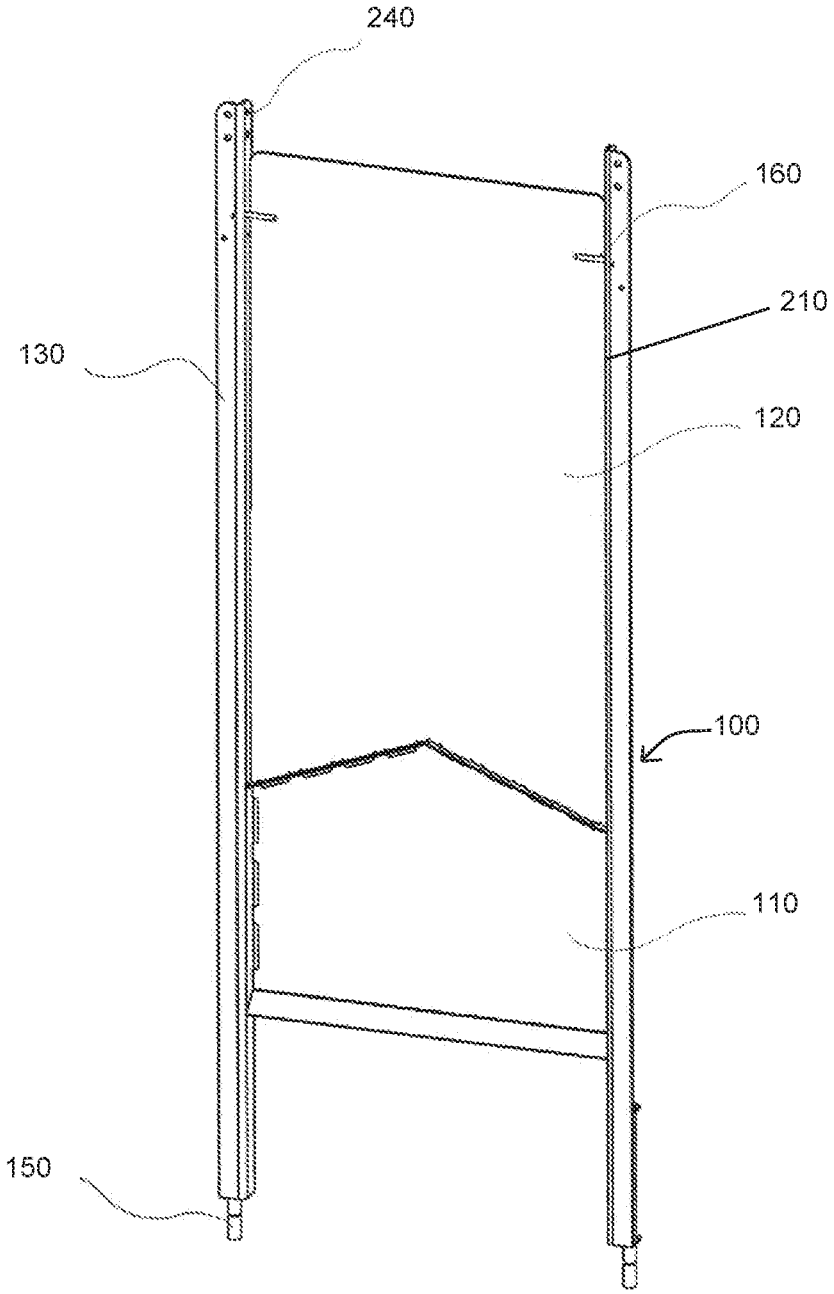
FIG. 1 shows a perspective view of a separator panel.
Figure 2:
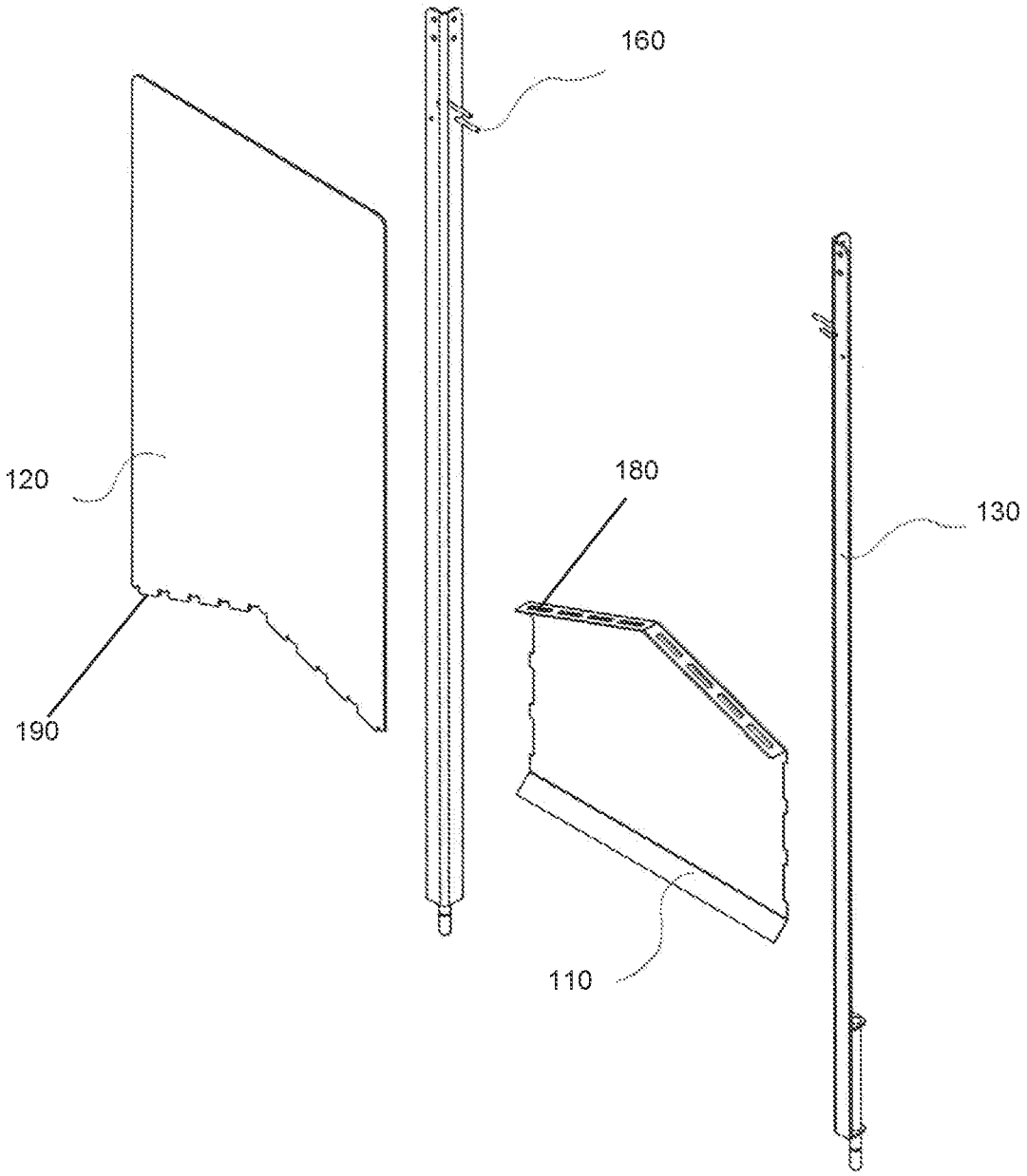
FIG. 2 shows an exploded view of the separator panel.
Figure 3:
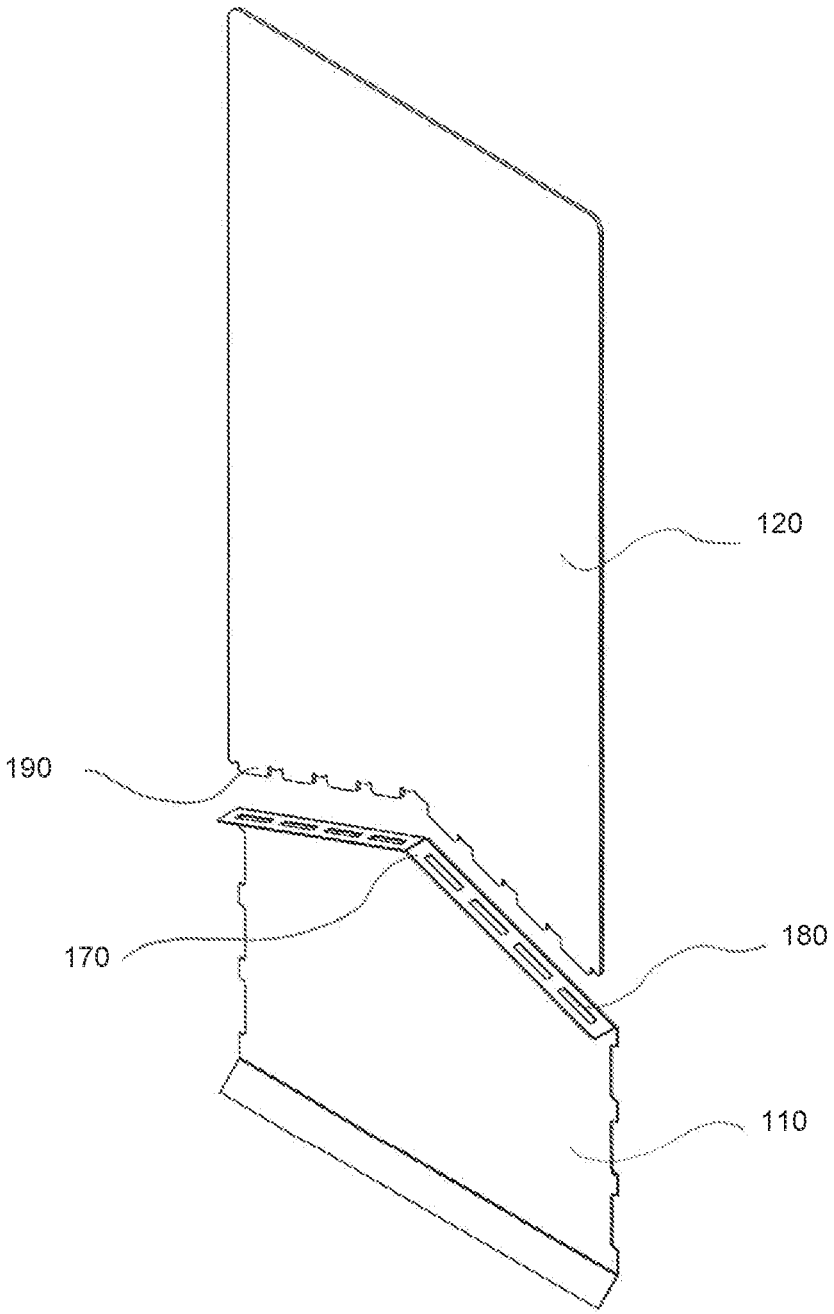
FIG. 3 shows a preferred embodiment of the separator panel.
Figure 4:
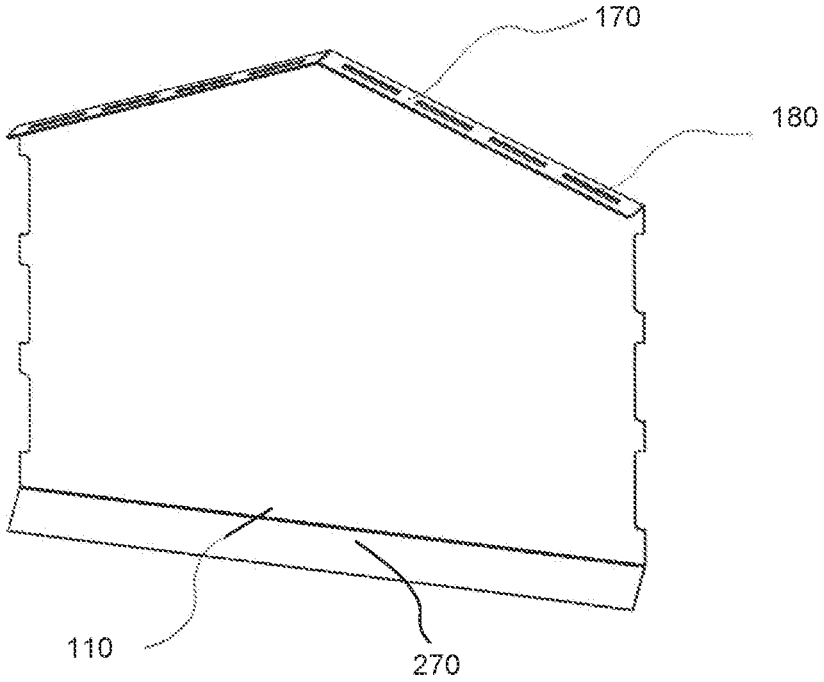
FIG. 4 shows a preferred embodiment of a lower separator panel.
Figure 5:
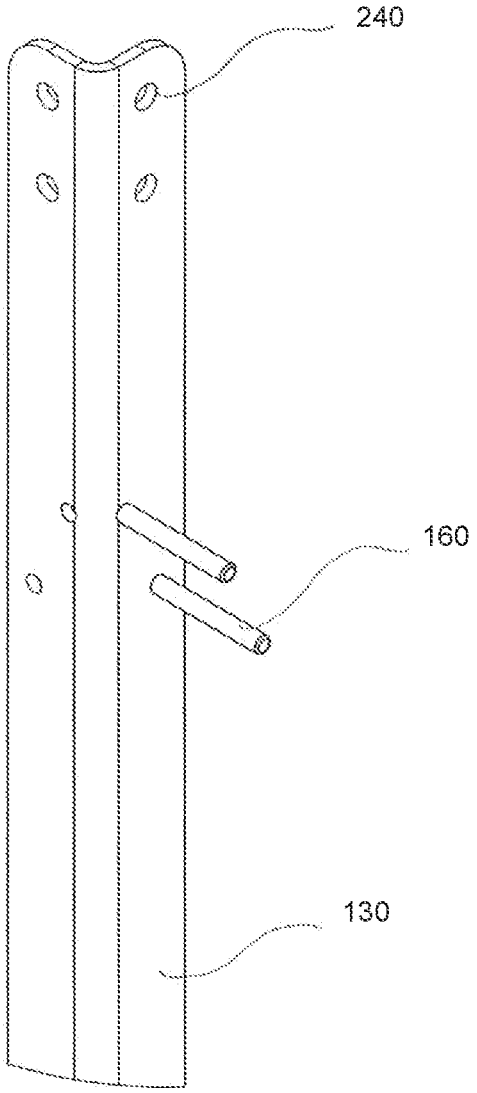
FIG. 5 shows an upper separator panel stabilizer bars and hanging feature.
Figure 6:
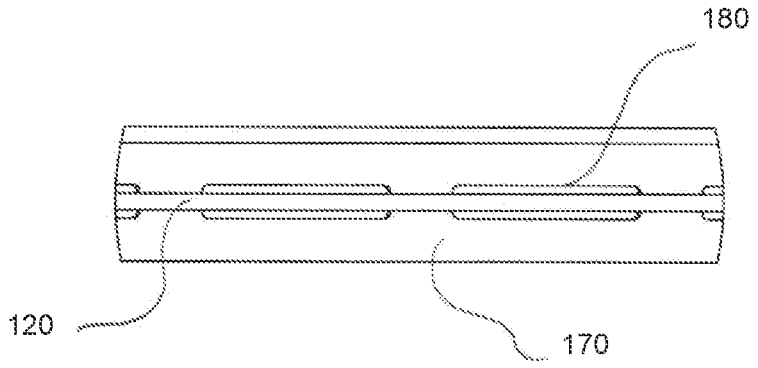
FIG. 6 shows interlocking slot and interlocking tab features.
Figure 6A:
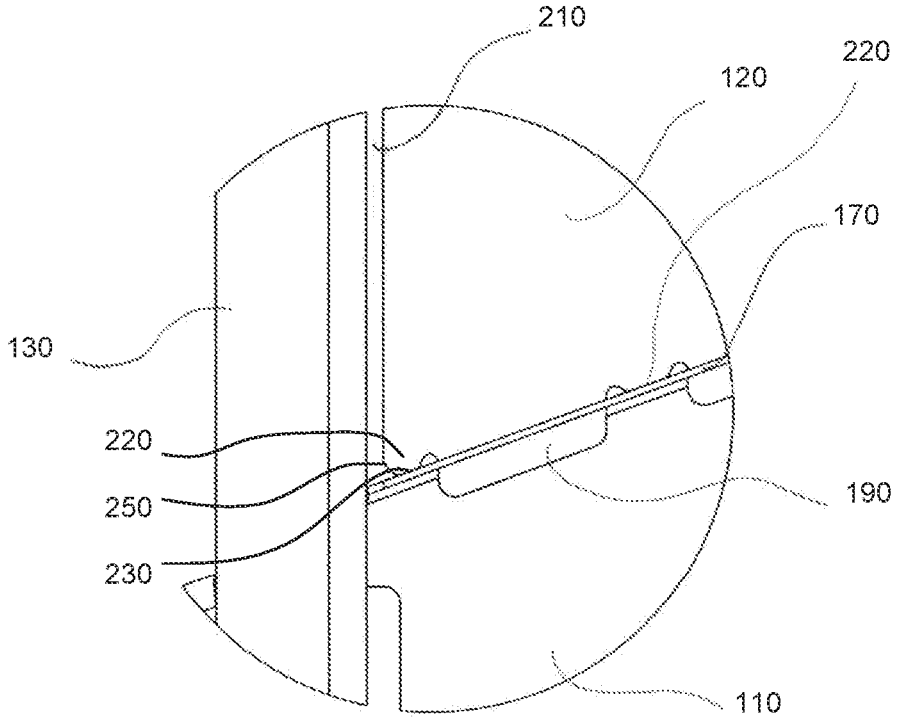
FIG. 6A shows a close up view of the interlocking slot and interlocking tab features.
Figure 7:
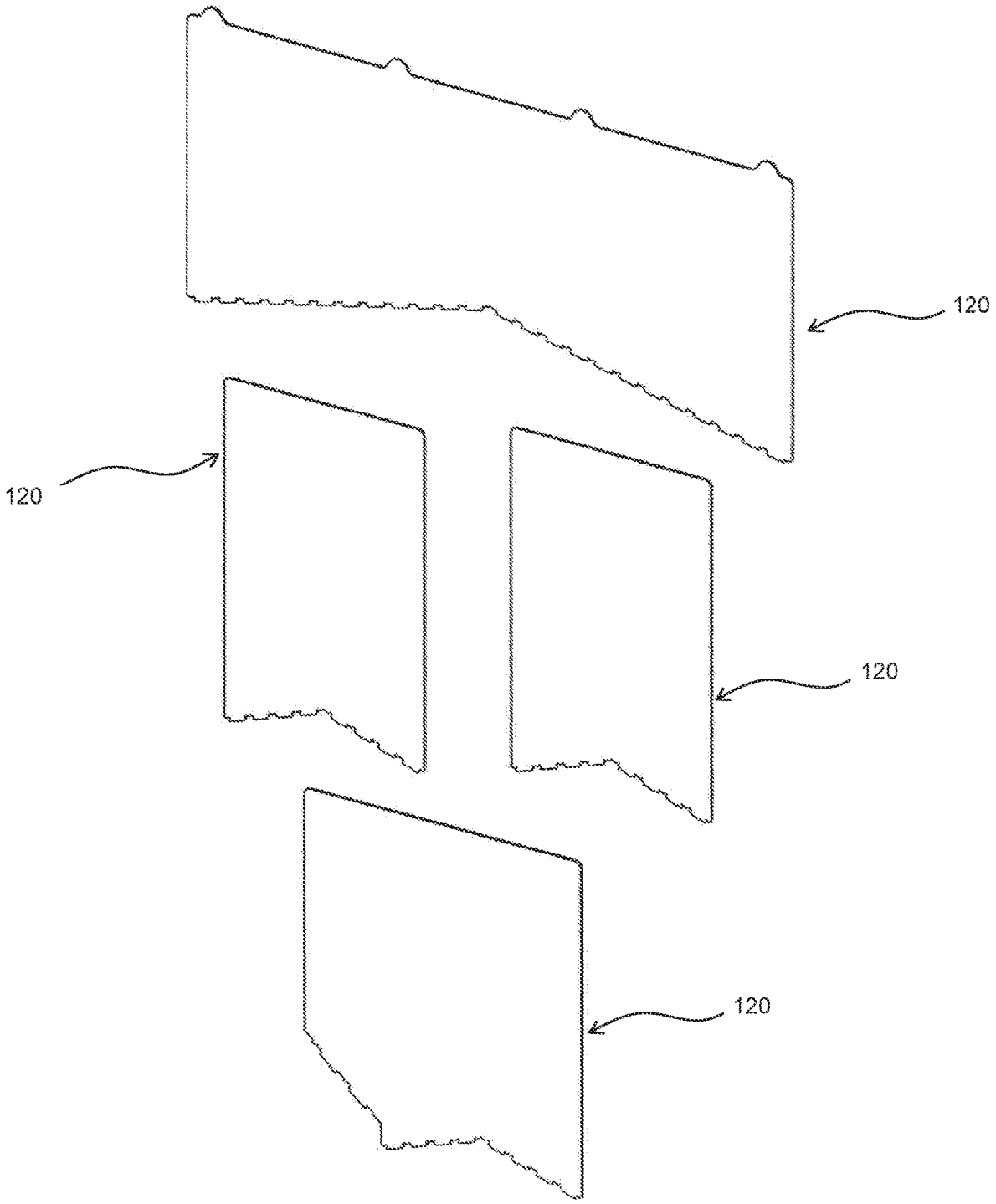
FIG. 7 shows various possible shapes and sizes of the upper separator panel.
Figure 8:
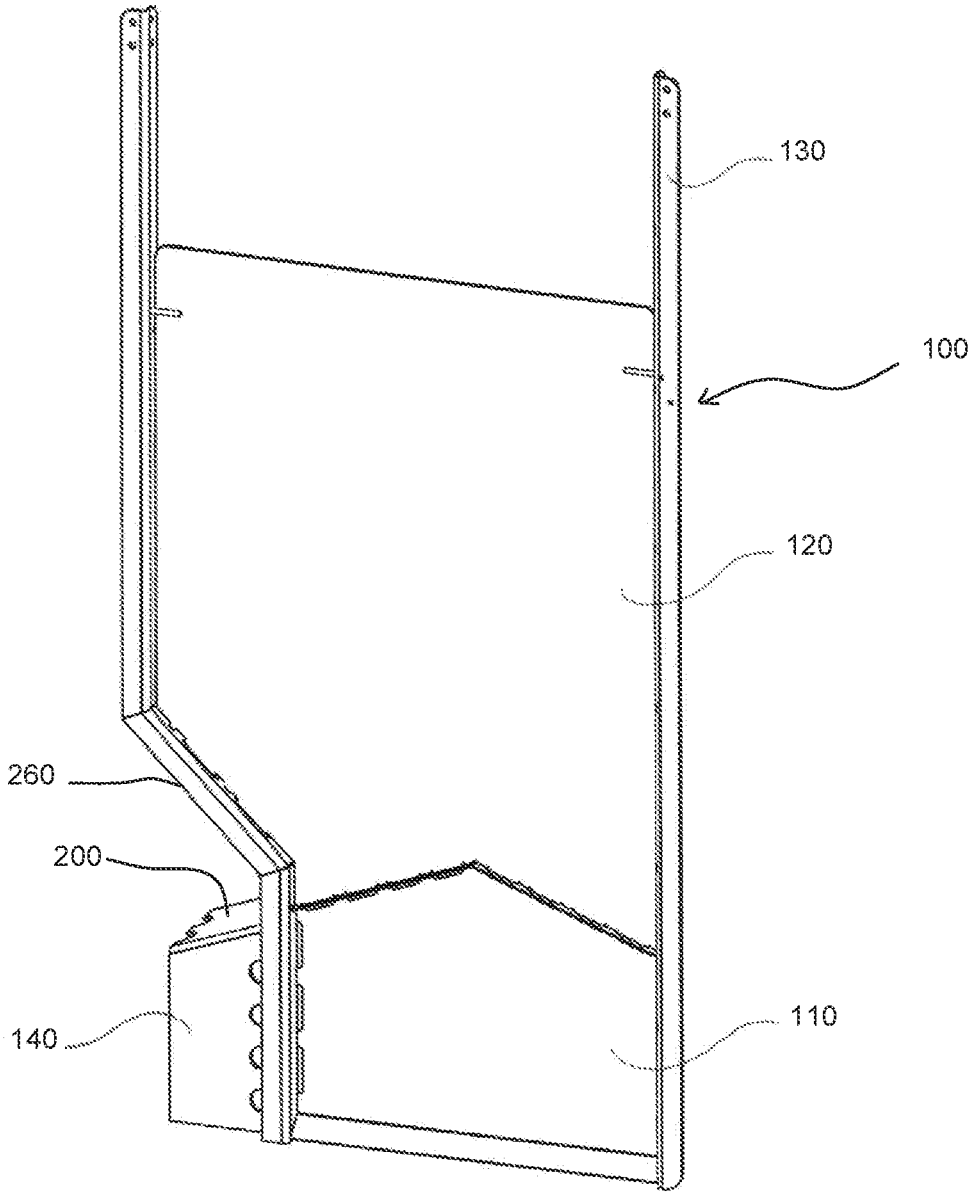
FIG. 8 shows a mounting bracket option.
Figure 9:
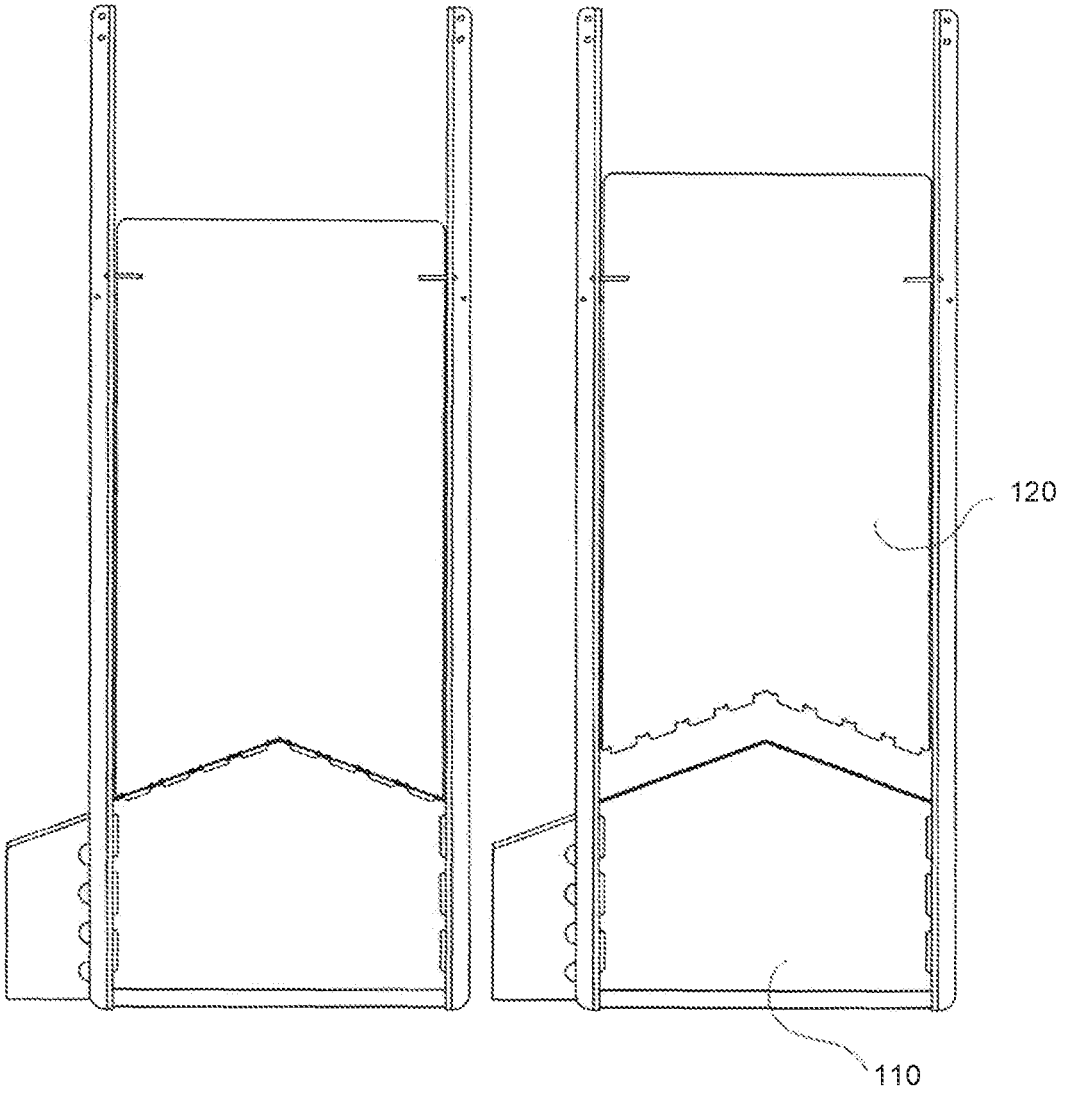
FIG. 9 shows the allowable vertical movement of the upper separator panel within the preferred embodiment.
Figure 10A:
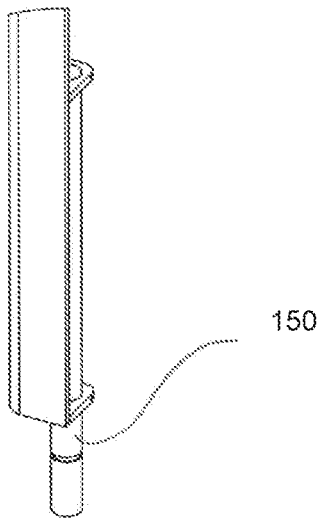
FIG. 10A shows the mounting foot, weldable mount, and vertical frame mounting feature.
Figure 10B:
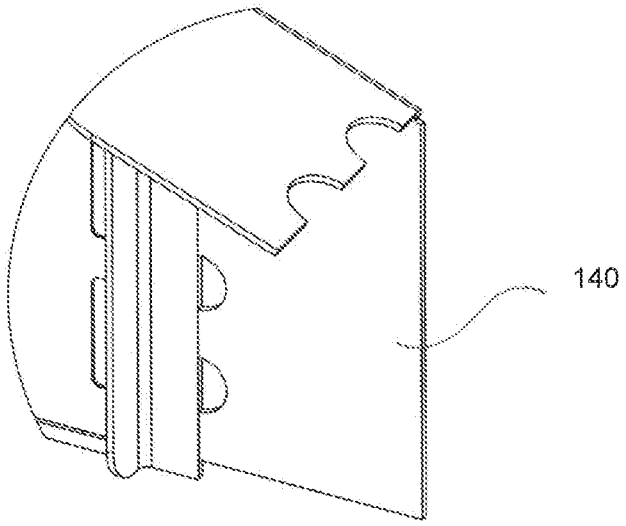
FIG. 10B shows a guard attached to the separator panel.
Figure 10C:
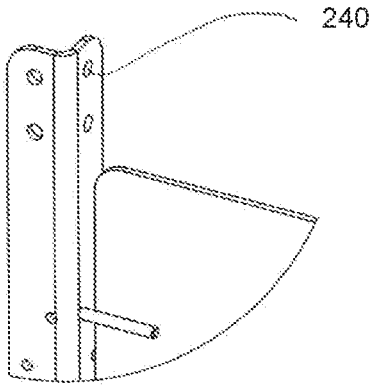
FIG. 10C shows holes in the vertical frame member.
Figure 11:
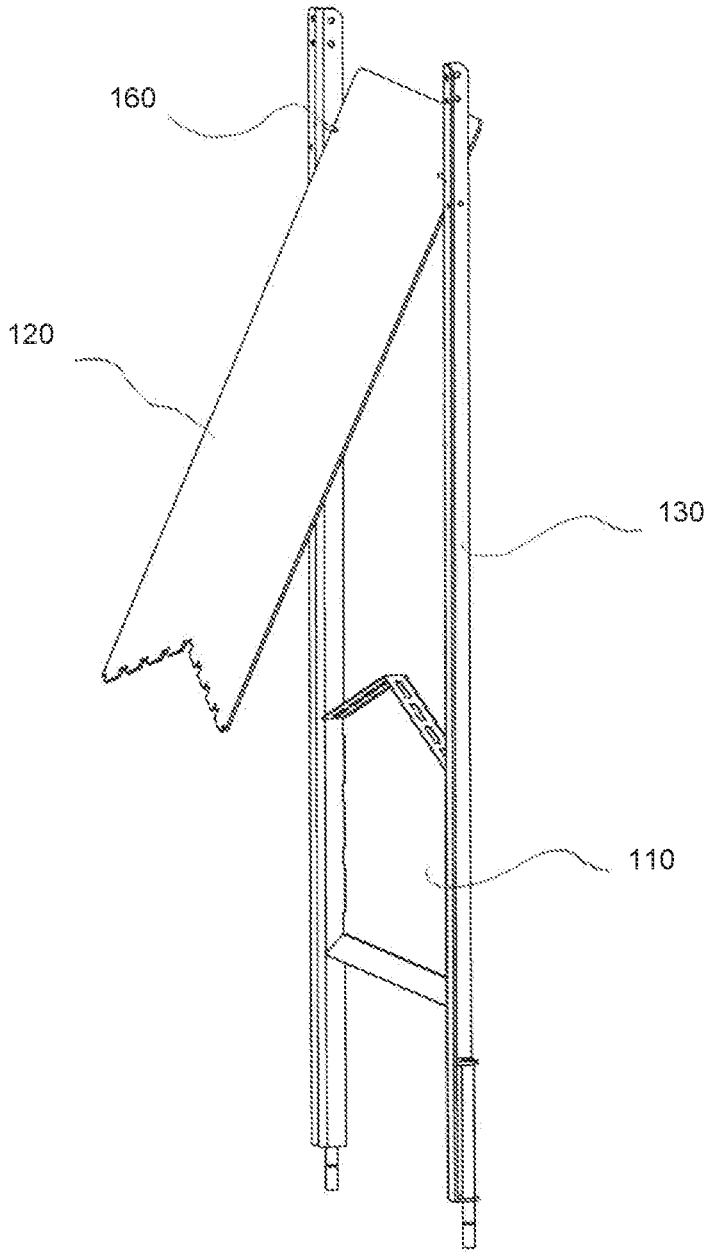
FIG. 11 depicts the upper panel pivoting about the panel stabilizer bars to allow for cleaning and disassembly.
Figure 12:
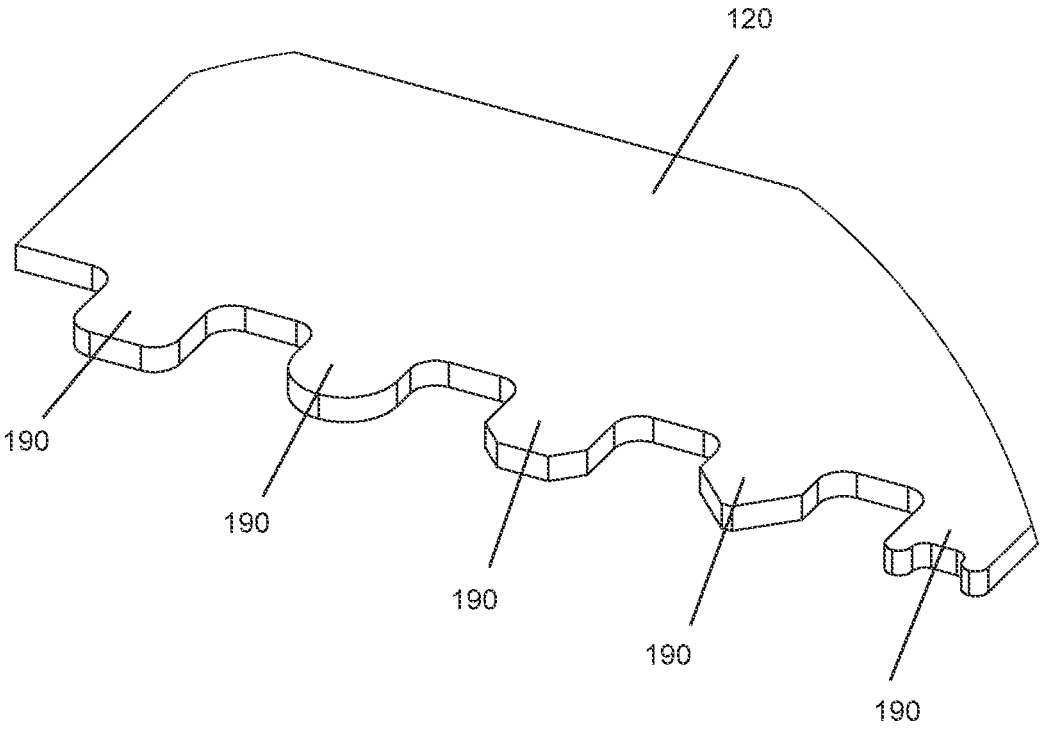
FIG. 12 depicts a few of the various shapes of the interlocking tab.

FIG. 1 shows the panel assembly 100 comprises a lower panel portion 110 and vertical frame members 130 located at each side of the lower panel portion 110. As shown in FIG. 2, the lower panel portion includes at least one slot 180. The lower panel portion 170 may include a watershed flange 170, which includes the at least one slot 180. The watershed flange 170 may include a plurality of slots 180. In one embodiment, the watershed flange 170 extends perpendicularly out from the top of the lower panel portion 110. In another embodiment, the watershed flange 170 extends at an acute angle with respect to the lower panel portion 110 such that the watershed flange 170 slopes downward to easily drain or deflect any material. The watershed flange 170 may slope downward at both sides.

The separator panel assembly 100 further includes vertical frame members 130 located at each side of the lower panel portion 110. The lower panel portion 110 may be welded to each vertical frame member 130. The lower panel portion 110 may also be attached with a fastener such as a screw or bolts, or may be glued to vertical frame members 130. In a preferred embodiment, the lower panel portion 110 will be attached such that all contact points are properly sealed against contaminants, such as by seal welding.

The separator panel assembly 100 further comprises an upper panel portion 120 located above the lower panel portion 110 and between the vertical frame members 130 located at each end of the lower panel portion 110. The upper panel portion 120 includes at least one interlock tab 190 at a lower end of the upper panel portion 120. The at least one interlock tab 190 fits into the at least one slot 180 of lower panel portion 110 to connect the upper panel portion 120 to the lower panel portion 110. In one embodiment the upper panel portion 120 includes a plurality of interlock tabs 190 to fit into a plurality of slots 180 in the lower panel portion 110. The dimensions of the at least one interlock tab 190 may be smaller than the dimensions of the at least one slot 180 such that the at least one interlock tab 190 is thinner and narrower than the slot 180 and does not touch any portion of the slot 180. The upper panel portion 120 may be entirely supported by the contact tabs 220, as disclosed herein.

The separator panel assembly 100 further includes at least one stabilizer pin 160 located at the vertical frame member 130, wherein the upper panel portion 120 is supported in an upright position by the at least one stabilizer pin 160. The stabilizer pin 160 may extend inward from the vertical frame member 130 toward the upper panel portion 120. Each side of the separator panel assembly 100 may include one stabilizer pin 160, wherein the upper panel portion 120 rests between the two stabilizer pins 160, and wherein one of the two stabilizer pins 160 is in front of the upper panel portion 120 and the other of the two stabilizer pins 160 is in back of the upper panel portion 120, to support the upper panel portion 120 in an upright position.

The at least one stabilizer pin 160 may also include two prongs and a groove between the two prongs, wherein the upper panel portion 120 is held between the prongs, in the groove. Such a stabilizer pin 160 may rotate in its vertical frame member 130 to allow for easy removal of the upper panel portion 120 for cleaning and replacement.

In one embodiment, the upper panel portion 120 does not touch any surface at its sides other than at least one stabilizer pin 160. A width of the upper panel portion 120 may be less than a width of the lower panel portion 110, such that when the vertical frame members are attached at the lower panel portion 110, a gap 210 exists on one or both sides of the upper panel portion 120 between the one or both sides of the upper panel portion 120 and the corresponding vertical frame member(s) 130.

The watershed flange 170 may extend at an angle from one or both sides of the lower panel portion 110. The watershed flange 170 may be angular at its top or may be rounded.

The upper panel portion 120 of the separator panel assembly may further include a contact tab 220 located adjacent to or in between interlock tabs 190. The contact tab 220 may be rounded at the corners 250 with a tip 230 of the contact tab 220. The contact tab 220 may be resting on a surface at the top of the lower panel portion 110 and supporting the weight of the upper panel portion 120. The contact tab 220 may have a rounded The separator panel assembly 100 may extend over a conveyor. The vertical frame member 130 may include an angled portion 260, wherein the upper panel portion 120 and the lower panel portion 110 are also angled to correspond with a shape of the vertical frame member 130.

The separator panel assembly 100 may also include, at the lower panel portion 110, a skirt 270 angled downward and outward at a bottom edge of the lower panel portion 110.

The lower panel portion 110 and the vertical frame members 130 are made of metal, and in a preferred embodiment, are made of stainless steel. The upper panel portion 120 may be made of polycarbonate glass, or some other durable translucent material.

The separation panel assembly 100 may be thoroughly sanitized without disassembly. In one embodiment, the only surface contacts on the separation panel assembly 100 are the minimized contact between the rounded trip 230 of the contact tab 220 and the top of the lower panel portion 110 and the contact between the upper panel portion 120 and the stabilizer pin 180. Although the separation panel assembly 100 may be properly sanitized without taking the separation panel assembly 100 apart, it can also be assembled and disassembled for easy cleaning, maintenance and replacement of the panels. To disassemble the separator panel assembly 100, the upper panel portion 120 may be lifted slightly to disengage the at least one interlock tab 190 from the at least one slot 180 of the lower panel portion 110. The upper panel portion 120 can then be pivoted about the stabilizer pins 160 such that it is angled with respect to the lower panel portion 110. The upper panel portion 120 can then be disengaged from the stabilizer pins 160 and freed. To reassemble, the upper panel portion 120 can be positioned between the stabilizer pins 160, then aligned with the lower panel portion 110 and lowered onto the lower panel portion 110, such that interlock tabs 190 engage with slots 180 and the upper panel portion 120 is supported by the contact tabs 220 on the top of the lower panel portion 110.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

I claim:

1. A separator panel assembly comprising:

a lower panel portion including a slot;

a vertical frame member located at each side of the lower panel portion;

an upper panel portion located above the lower panel portion and between the vertical frame members located at each side of the lower panel portion, wherein the upper panel portion includes:

an interlock tab at a lower end of the upper panel portion, and wherein the interlock tab fits inside the slot of the lower panel portion;

at least one contact tab located adjacent to the interlock tab at the lower end of the upper panel portion; and wherein the at least one contact tab supports the upper panel portion at an upper edge of the lower panel portion; and at least one stabilizer pin located at at least one of the vertical frame members, wherein the upper panel portion is supported in an upright position by the at least one stabilizer pin;

wherein a width of the upper panel portion is less than a width of the lower panel portion so that a gap exists between at least one side of the upper panel portion and the corresponding vertical frame member, such that the upper panel portion and the corresponding vertical frame member do not touch.

2. The separator panel assembly according to claim 1, wherein the at least one stabilizer pin includes a first stabilizer pin and a second stabilizer pin, wherein the upper panel portion rests between the first stabilizer pin and the second stabilizer pin.

3. The separator panel assembly according to claim 1, wherein the lower panel portion further comprises a watershed flange located at the upper edge of the lower panel portion and extending at least one of in front of and behind the lower panel portion, wherein the at least one contact tab rests on a surface of the watershed flange.

4. The separator panel assembly according to claim 3, wherein the watershed flange is one chosen extending perpendicularly, rounded, and angled downward with respect to the lower panel portion.

5. The separator panel assembly according to claim 1, wherein the at least one contact tab includes a rounded corner with a rounded tip, wherein only the rounded tip touches the upper edge of the lower panel portion to minimize contact between the at least one contact tab and the upper edge of the lower panel portion.

6. The separator panel assembly according to claim 1, wherein the interlock tab is thinner and narrower than the slot such that the interlock tab does not touch the slot.

7. The separator panel assembly according to claim 1, wherein the separator panel assembly is one chosen from free standing and connected to at least one chosen from a ceiling, a floor, a conveyor, and a fixture.

8. The separator panel assembly according to claim 1, further comprising at least one chosen from an upper frame member, a mounting foot, and a mounting bracket.

9. The separator panel assembly according to claim 8, wherein the lower panel portion includes a mounting bracket extending outward from the vertical frame member.

10. The separator panel assembly according to claim 1, wherein the vertical frame member, at least at one side of the separator panel assembly, includes an angled portion, and wherein the upper panel portion and the lower panel portion are angled to correspond with a shape of the vertical frame member.

11. The separator panel assembly according to claim 1, wherein the lower panel portion includes a skirt angled downward and outward at a bottom edge of the lower panel portion.

12. The separator panel assembly according to claim 1, wherein the lower panel portion is at least one chosen from welded, fastened with screws, and glued to each vertical frame member.

13. The separator panel assembly according to claim 12, wherein the lower panel portion is seal welded to each vertical frame member.

14. The separator panel assembly according to claim 1, wherein the lower panel portion further comprises a guard extending perpendicularly away from the separator panel assembly.

15. The separator panel assembly according to claim 1, wherein the lower panel portion is made of stainless steel and wherein the upper panel portion is made of polycarbonate glass.

16. The separator panel assembly according to claim 1, wherein the upper panel portion does not touch any surface at sides of the upper panel portion other than the at least one stabilizer pin located at each vertical frame member.

17. A method of disassembling a separator panel assembly, comprising:

providing:

a lower panel portion located between two vertical frame members, wherein the lower panel portion includes a slot; and an upper panel portion including an interlock tab that fits into the slot of the lower panel portion;

at least one stabilizer pin located at each of the two vertical frame members, wherein the upper panel portion is supported by the at least one stabilizer pin;

lifting the upper panel portion such that the interlock tab disengages from the slot;

pivoting the upper panel portion about the stabilizer pins such that the upper panel portion is angled with respect to the lower panel portion; and disengaging the upper panel portion from the stabilizer pins.

* * * * *